US011189953B2

(12) United States Patent
Baza et al.

(10) Patent No.: US 11,189,953 B2
(45) Date of Patent: Nov. 30, 2021

(54) CONNECTOR-ASSEMBLY WITH PRIMARY-LOCK-REINFORCEMENT DEVICE

(71) Applicant: Aptiv Technologies Limited, St. Michael (BB)

(72) Inventors: Darien Aguilar Baza, Saltillo (MX); Francisco J. Hernandez Camarillo, Saltillo (MX)

(73) Assignee: APTIV TECHNOLOGIES LIMITED

( * ) Notice: Subject to any disclaimer, the term of this patent is extended or adjusted under 35 U.S.C. 154(b) by 56 days.

(21) Appl. No.: 16/115,005

(22) Filed: Aug. 28, 2018

(65) Prior Publication Data

US 2020/0076110 A1 Mar. 5, 2020

(51) Int. Cl.
*H01R 13/436* (2006.01)
*H01R 13/424* (2006.01)

(52) U.S. Cl.
CPC ..... *H01R 13/4365* (2013.01); *H01R 13/424* (2013.01)

(58) Field of Classification Search
CPC ..... H01R 13/424; H01R 13/436; H01R 13/4361; H01R 13/4362; H01R 13/4364; H01R 13/4365; H01R 13/4367; H01R 13/4368
See application file for complete search history.

(56) References Cited

U.S. PATENT DOCUMENTS 4,973,268 A * 11/1990 Smith ..... H01R 13/4365 439/589
5,486,118 A * 1/1996 Colleran ..... H01R 13/436 439/374
6,475,014 B2 * 11/2002 Tsuji ..... H01R 13/641 439/352
6,579,118 B2 * 6/2003 Endo ..... H01R 13/6272 439/352
6,827,609 B1 * 12/2004 Martin ..... H01R 13/4365 439/595
7,625,251 B2 * 12/2009 Martin ..... H01R 13/4223 439/752

(Continued)

*Primary Examiner* — Edwin A. Leon
*Assistant Examiner* — Milagros Jeancharles
(74) *Attorney, Agent, or Firm* — Billion & Armitage

(57) ABSTRACT

A connector assembly includes electrical terminals, a connector housing, and a primary lock reinforcement device. The electrical terminals are configured to mate with corresponding electrical terminals along a mating axis of the connector assembly. The connector housing is configured to retain the electrical terminals within terminal cavities defined by a terminal tower disposed within the connector housing. The primary lock reinforcement device is configured to slideably engage the terminal tower and is moveable from a prestaged position to a full staged position. The primary lock reinforcement device has a base and a skirt defining a cavity having a flexible beam disposed within and terminating at a tip. The tip engages a stop in the connector housing in the prestaged position inhibiting a movement of the primary lock reinforcement device along the mating axis. When the electrical terminals are fully seated into the terminal cavities, the electrical terminals disengage the tip from the stop enabling the primary lock reinforcement device to move from the prestaged position to the full staged position.

16 Claims, 4 Drawing Sheets

(56) References Cited

U.S. PATENT DOCUMENTS

| | | | | |
|---|---|---|---|---|
| 9,318,841 | B2 * | 4/2016 | Gimbel | H01R 13/5202 |
| 10,122,113 | B1 * | 11/2018 | Bonucci | H01R 13/428 |
| 10,186,803 | B1 * | 1/2019 | Hocevar | H01R 13/6273 |
| 10,276,966 | B1 * | 4/2019 | Hitchcock | H01R 13/4538 |
| 10,312,624 | B1 * | 6/2019 | Baza | H01R 13/62 |
| 10,348,019 | B1 * | 7/2019 | Hocevar | H01R 13/4223 |
| 10,418,742 | B1 * | 9/2019 | Gonzalez Delgadillo | H01R 13/426 |
| 10,446,968 | B1 * | 10/2019 | Weber, Jr. | H01R 13/424 |
| 2005/0176298 | A1 * | 8/2005 | Flowers | H01R 13/4365 439/595 |

* cited by examiner

CONNECTOR-ASSEMBLY WITH PRIMARY-LOCK-REINFORCEMENT DEVICE

TECHNICAL FIELD OF INVENTION

This disclosure generally relates to an electrical connector assembly, and more particularly relates to an electrical connector assembly with a primary lock reinforcement device.

BRIEF DESCRIPTION OF DRAWINGS

The present invention will now be described, by way of example with reference to the accompanying drawings, in which.

DETAILED DESCRIPTION

Reference will now be made in detail to embodiments, examples of which are illustrated in the accompanying drawings. In the following detailed description, numerous specific details are set forth in order to provide a thorough understanding of the various described embodiments. However, it will be apparent to one of ordinary skill in the art that the various described embodiments may be practiced without these specific details. In other instances, well known methods, procedures, components, circuits, and networks have not been described in detail so as not to unnecessarily obscure aspects of the embodiments.

Figure 1:
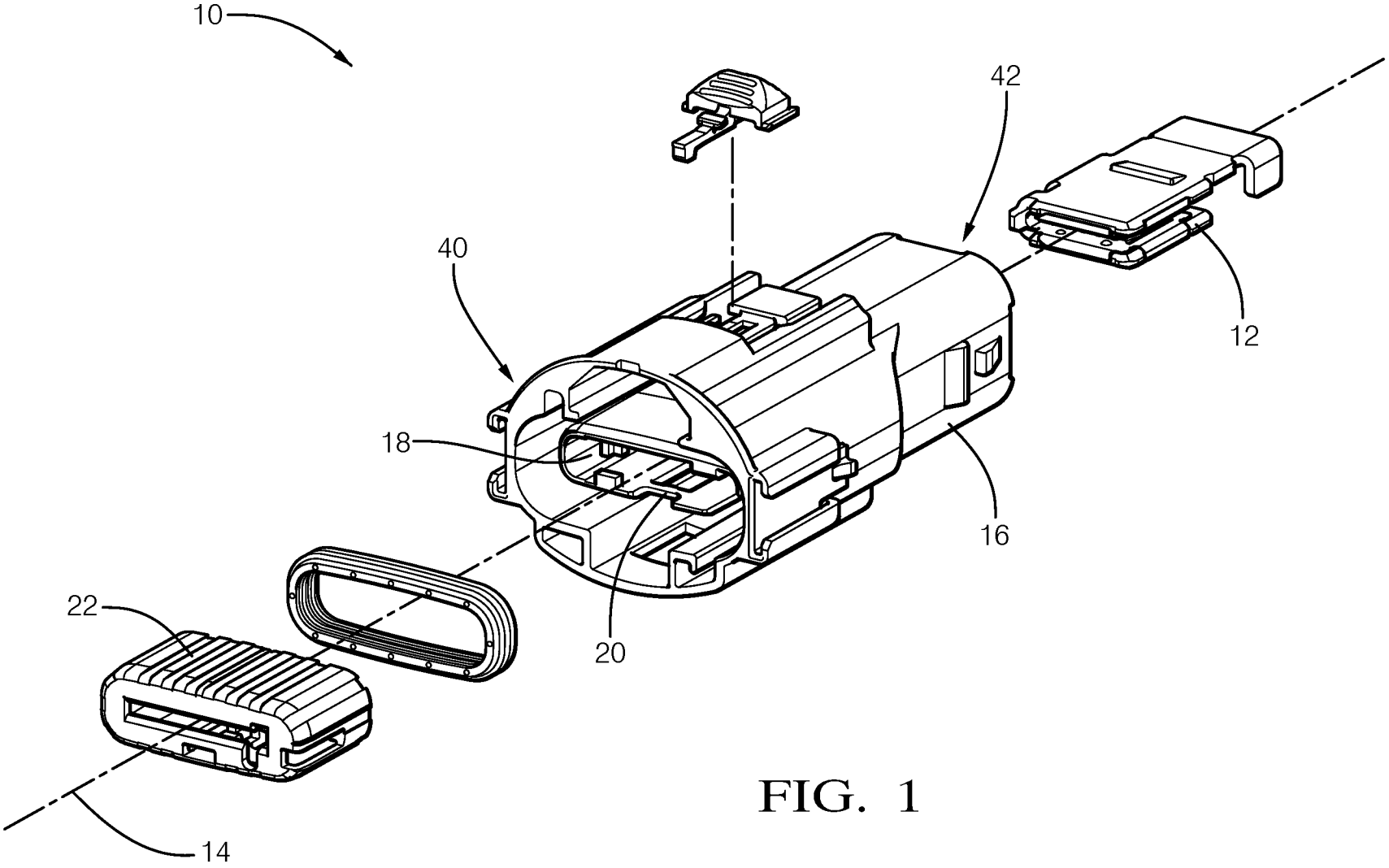
FIG. 1 is an exploded perspective view illustrating a connector assembly in accordance with one embodiment.

FIG. 1 is an exploded view illustrating a connector assembly 10. As will be described in more detail below, the connector assembly 10 is an improvement over prior art connector assemblies, because the connector assembly 10 maintains a position of its components during shipping and handling and inhibits inadvertent and/or premature movement. The connector assembly 10 includes one or more electrical terminals, hereinafter referred to as the terminals 12, configured to mate with one or more corresponding electrical terminals (not shown) along a mating axis 14 of the connector assembly 10. The terminals 12 are formed of an electrically conductive material, such as a copper-based alloy that may also include a coating of another conductive material (e.g., a tin-based or silver-based coating). The terminals 12 are configured to be attached to wire cables (not shown) that may be a component of a wiring harness of a vehicle.

The connector assembly 10 also includes a connector housing 16 configured to retain the terminals 12 within one or more terminal cavities, hereinafter referred to as the cavities 18, defined by a terminal tower 20 disposed within the connector housing 16. The connector housing 16 is formed of a polymeric dielectric material. The polymeric dielectric material may be any polymeric dielectric material capable of electrically isolating portions of the terminals 12 and is preferably a polyamide (NYLON) material.

The connector assembly 10 also includes a primary lock reinforcement device 22 (PLR device 22) configured to slidably engage the terminal tower 20. The PLR device 22 is preferably formed of the same polymeric dielectric material as the connector housing 16 but may be any polymeric dielectric material. The PLR device 22 is moveable from a prestaged position 24 to a full staged position 26, as will be explained in more detail below.

Figure 2:
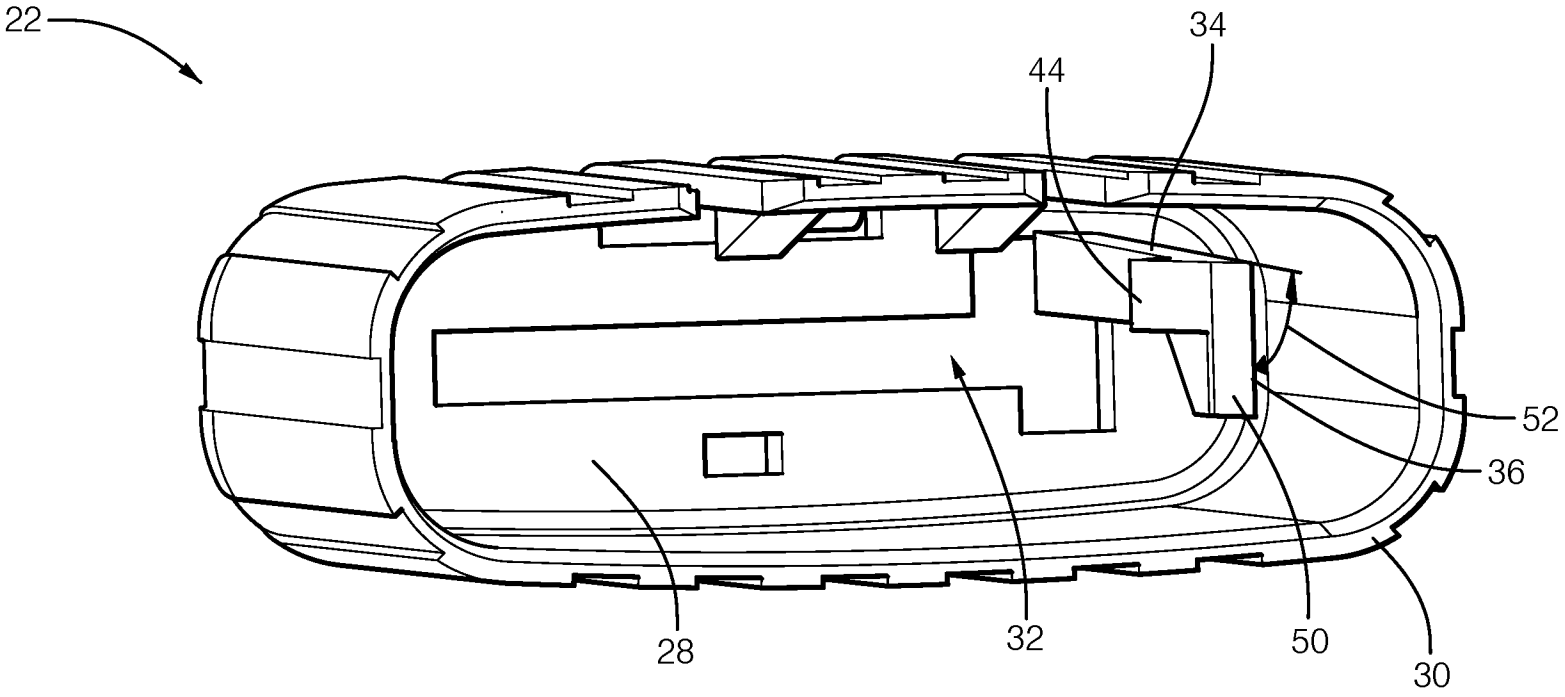
FIG. 2 is a perspective end view of a primary lock reinforcement device isolated from the assembly of FIG. 1 in accordance with one embodiment.

FIG. 2 illustrates the PLR device 22 isolated from the connector assembly 10 of FIG. 1. The PLR device 22 has a base 28 and a skirt 30 defining a cavity 32. A flexible beam 34 is disposed within the cavity 32 extending from the base 28 parallel to the mating axis 14 and terminating at a tip 36. The base 28 also defines one or more apertures (not specifically shown) through which the corresponding electrical terminals pass when mating with the terminals 12. In the example illustrated in FIG. 2, the flexible beam 34 is formed integral to the base 28. The tip 36 is configured to engage a stop 38 (see FIGS. 3A-3B) formed in the connector housing 16 when the PLR device 22 is in the prestaged position 24, thereby inhibiting a movement of the PLR device 22 along the mating axis 14. In the example illustrated in FIG. 2 the stop 38 is disposed within the cavities 18. In another embodiment, the stop 38 is located on the terminal tower 20 external to the cavities 18.

Figure 3A:
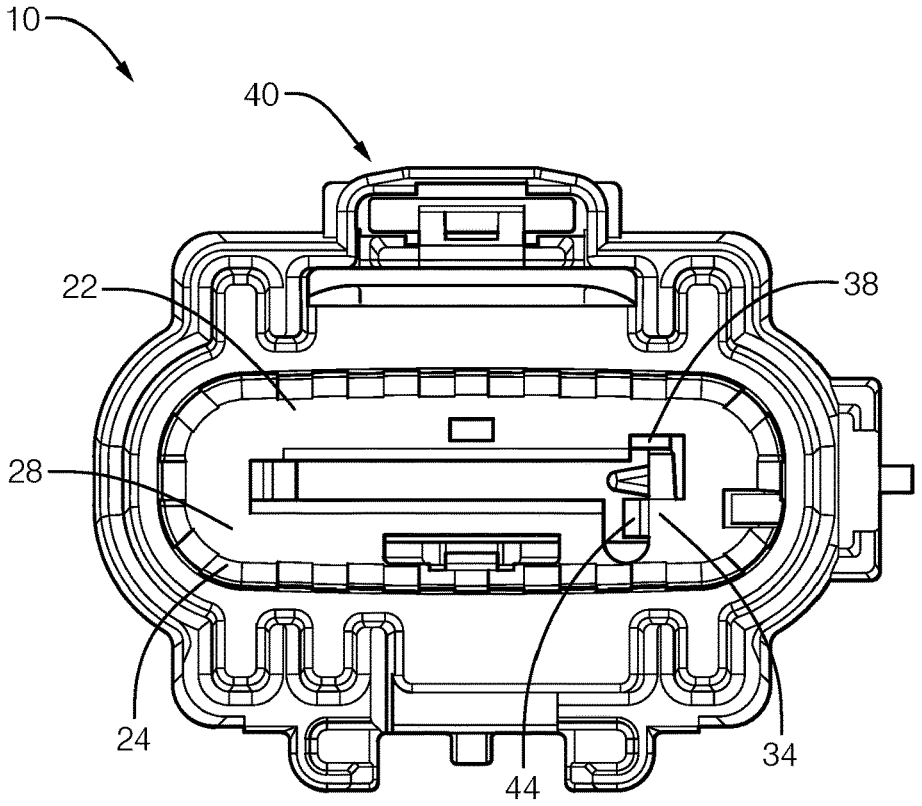
FIG. 3A is a terminal end view of the connector assembly of FIG. 1 in accordance with one embodiment.
Figure 3B:
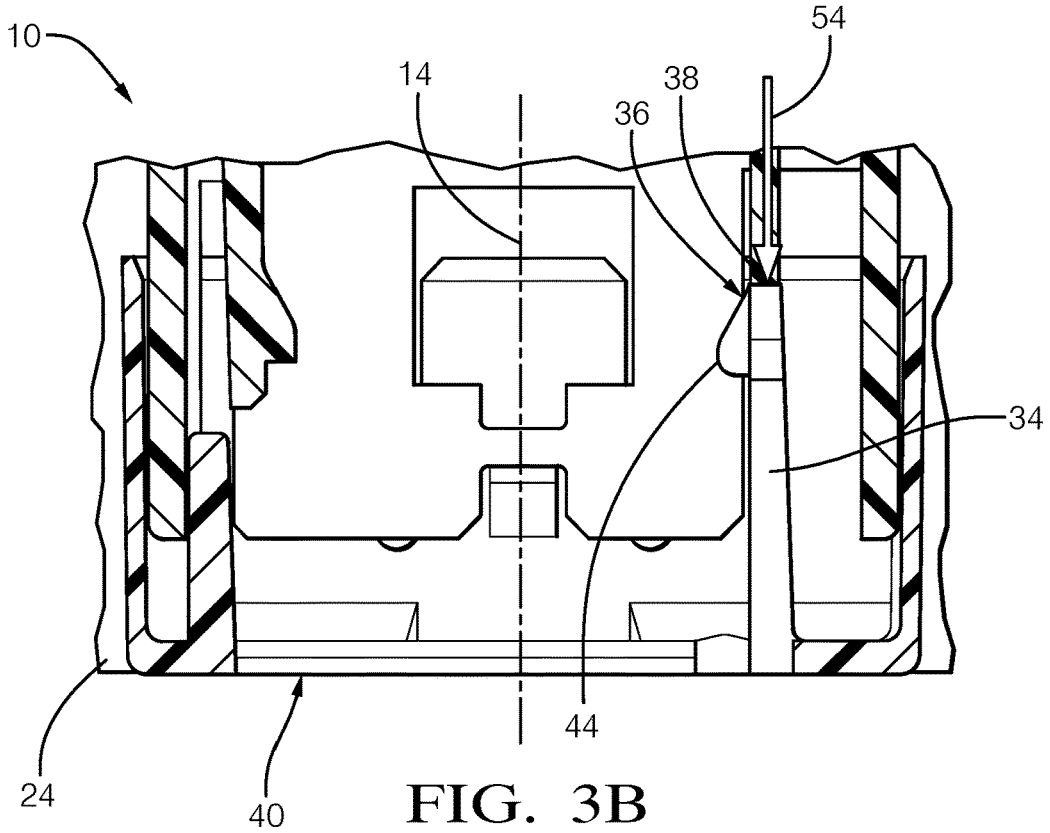
FIG. 3B is a top section view of the connector assembly of FIG. 3A in accordance with one embodiment.

FIG. 3A is a terminal end 40 view of the connector assembly 10 of FIG. 1 with the PLR device 22 in the prestaged position 24 and illustrates the stop 38 within the connector housing 16. FIG. 3B is a top section view of a portion of the connector assembly 10 of FIG. 3A illustrating the interaction between the tip 36 of the flexible beam 34 and the stop 38, with the PLR device 22 in the prestaged position 24. The prestaged position 24 enables an assembler to insert the terminals 12 into the connector housing 16 through a wire end 42 of the connector housing 16 (see FIG. 1) to be seated within the cavities 18. It will be appreciated that if the PLR device 22 is inadvertently moved to the full staged position 26, as can result during shipping and handling, the assembler will be inhibited from fully inserting the terminals 12 into the connector housing 16.

Figure 4A:
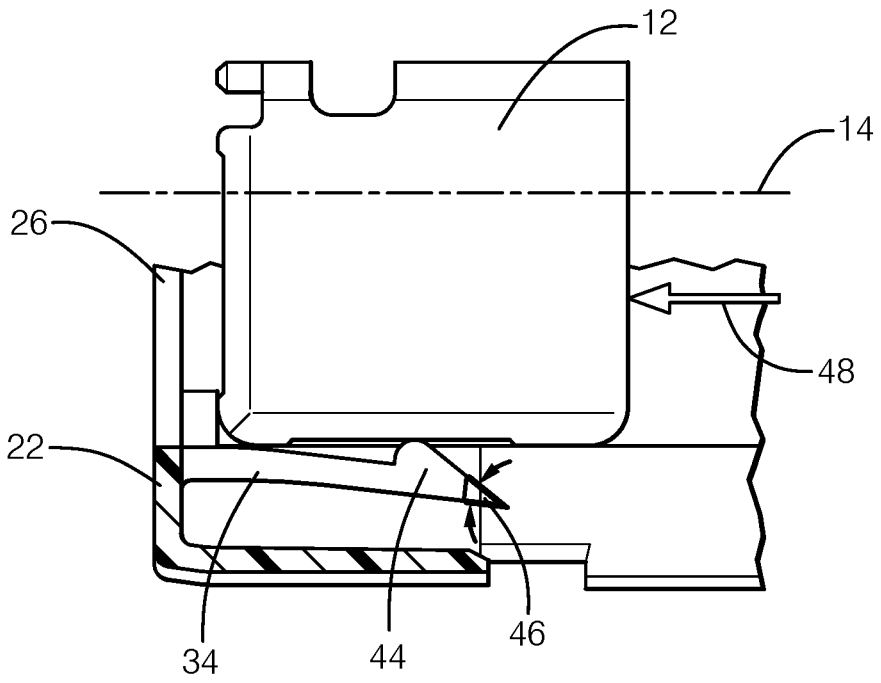
FIG. 4A is a section view of a portion of the connector assembly of FIG. 1 with an electrical terminal fully seated and the primary lock reinforcement device in a full staged position in accordance with one embodiment.
Figure 4B:
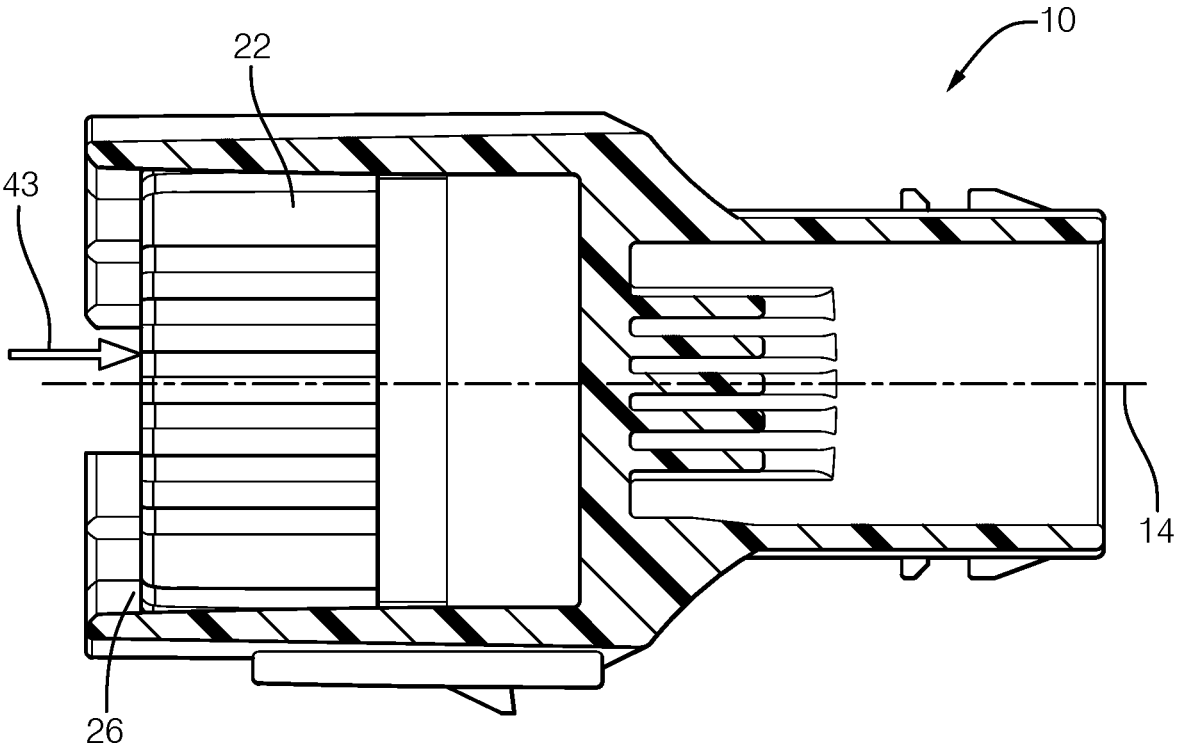
FIG. 4B is a section view of the connector assembly of FIG. 1 with the primary lock reinforcement device in the full staged position in accordance with one embodiment.

FIGS. 4A-4B illustrate the PLR device 22 in the full staged position 26. When the terminals 12 are inserted into the cavities 18, the terminals 12 deflect the flexible beam 34 disengaging the tip 36 from the stop 38, thereby enabling the PLR device 22 to move from the prestaged position 24 to the full staged position 26 when the terminals 12 are fully seated in the cavities 18. The terminals 12 must be fully seated before the PLR device 22 may be moved to the full staged position 26 due to one or more terminal locks (not specifically shown) that also inhibit the movement of the PLR device 22 until the terminal locks are latched in corresponding terminal notches (not specifically shown) of the terminals 12. For ergonomic reasons, a force 43 of less than 45 Newtons is required to move the PLR device 22 from the prestaged position 24 to the full staged position 26 when the terminals 12 is fully seated in the cavities 18.

Referring back to FIG. 4A, the tip 36 of the flexible beam 34 includes an unlocking ramp 44 configured to engage a leading edge of the terminals 12 as the terminals 12 are inserted into the cavities 18. The unlocking ramp 44 extends into the cavities 18 in a direction generally orthogonal to the mating axis 14 as illustrated in FIGS. 3A-3B. The unlocking ramp 44 is characterized as having the engagement angle 46 relative to the mating axis 14 of between 20 degrees and 80 degrees so that an insertion force 48 applied to the terminals 12 of less than 30 Newtons is required to deflect the flexible beam 34. A cross-sectional area and a length of the flexible beam 34 may be adjusted along with the engagement angle 46 to meet the insertion force 48 target.

Referring back to FIG. 2, the tip 36 of the flexible beam 34 includes a blocking fin 50 configured to engage the stop 38. The blocking fin 50 extends from the tip 36 in a direction generally orthogonal to the mating axis 14 and generally orthogonal to the unlocking ramp 44. The blocking fin 50 is characterized as having a blocking angle 52 relative to the mating axis 14 of about 90 degrees. The blocking fin 50 engages the stop 38 such that a blocking force 54 (see FIG. 3B) greater than 80 Newtons is required to move the PLR device 22 from the prestaged position 24 to the full staged position 26 when the terminals 12 are not fully seated in the cavities 18. The blocking force 54 of greater than 80 Newtons is advantageous because the blocking force 54 is sufficiently greater than the force 43 required to move the PLR device 22 from the prestaged position 24 to the full staged position 26 (when the terminals 12 are fully seated in the cavities 18). The blocking force 54 may alert an assembler to an unseated condition and take actions to correct the issue before further process steps are conducted.

Accordingly, a connector assembly 10 is provided. The connector assembly 10 is an improvement over prior art connector assemblies because the connector assembly 10 includes the PLR device 22 that resists movement from the prestaged position 24 to the full staged position 26 until the terminals 12 are fully seated in the cavities 18, thereby providing the benefit of alerting an assembler to an unseated terminal condition.

While this invention has been described in terms of the preferred embodiments thereof, it is not intended to be so limited, but rather only to the extent set forth in the claims that follow. "One or more" includes a function being performed by one element, a function being performed by more than one element, e.g., in a distributed fashion, several functions being performed by one element, several functions being performed by several elements, or any combination of the above. It will also be understood that, although the terms first, second, etc. are, in some instances, used herein to describe various elements, these elements should not be limited by these terms. These terms are only used to distinguish one element from another. For example, a first contact could be termed a second contact, and, similarly, a second contact could be termed a first contact, without departing from the scope of the various described embodiments. The first contact and the second contact are both contacts, but they are not the same contact. The terminology used in the description of the various described embodiments herein is for the purpose of describing particular embodiments only and is not intended to be limiting. As used in the description of the various described embodiments and the appended claims, the singular forms "a", "an" and "the" are intended to include the plural forms as well, unless the context clearly indicates otherwise. It will also be understood that the term "and/or" as used herein refers to and encompasses any and all possible combinations of one or more of the associated listed items. It will be further understood that the terms "includes," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "if" is, optionally, construed to mean "when" or "upon" or "in response to determining" or "in response to detecting," depending on the context. Similarly, the phrase "if it is determined" or "if [a stated condition or event] is detected" is, optionally, construed to mean "upon determining" or "in response to determining" or "upon detecting [the stated condition or event]" or "in response to detecting [the stated condition or event]," depending on the context. Directional terms such as top, bottom, upper, lower, left, right, front, rear, etc. do not denote any particular orientation, but rather these directional terms are used to distinguish one element from another and establish a relationship between the various elements.

We claim:

1. A connector assembly, comprising:

an electrical terminal configured to mate with a corresponding electrical terminal along a mating axis of the connector assembly;

a connector housing configured to retain the electrical terminal within a terminal cavity defined by a terminal tower integrally formed by the connector housing; and a primary lock reinforcement device separate from the connector housing and configured to slidably engage the terminal tower, wherein the primary lock reinforcement device is moveable from a prestaged position to a full staged position, wherein the primary lock reinforcement device has a base and a skirt defining a cavity, wherein the primary lock reinforcement device has a flexible beam disposed within the cavity that extends from the base parallel to the mating axis and terminates at a tip, wherein the flexible beam defines an unlocking ramp increasing in thickness from the tip at an engagement angle and the flexible beam further defines a blocking fin decreasing in thickness from the tip, wherein the blocking fin is arranged orthogonally to the unlocking ramp, wherein a direction of the increasing thickness of the unlocking ramp is orthogonal to the direction of the decreasing thickness of the blocking fin, wherein the blocking fin is positioned to engage a stop formed in the connector housing when the primary lock reinforcement device is in the prestaged position and the electrical terminal is not inserted within the terminal cavity, thereby inhibiting a movement of the primary lock reinforcement device along the mating axis, wherein the tip of the unlocking ramp is configured to engage a leading edge of the electrical terminal and to defect the flexible beam such that it is nonparallel to the mating axis when the electrical terminal is inserted into the terminal cavity, thereby disengaging the blocking fin from the stop and enabling the primary lock reinforcement device to move from the prestaged position to the full staged position.

2. The connector assembly in accordance with claim 1, wherein a force of less than 45 Newtons is required to move the primary lock reinforcement device from the prestaged position to the full staged position after the electrical terminal is inserted into the terminal cavity.

3. The connector assembly in accordance with claim 1, wherein the engagement angle is between 20 degrees and 80 degrees.

4. The connector assembly in accordance with claim 3, wherein an insertion force applied to the electrical terminal of less than 30 Newtons is required to deflect the flexible beam.

5. The connector assembly in accordance with claim 1, wherein the blocking fin is characterized as having a blocking angle relative to the mating axis of about 90 degrees.

6. The connector assembly in accordance with claim 1, wherein a blocking force greater than 80 Newtons is required to move the primary lock reinforcement device from the prestaged position to the full staged position when the electrical terminal is not fully seated in the one or more terminal cavities.

7. The connector assembly in accordance with claim 1, wherein the stop is disposed within the terminal cavity.

8. The connector assembly in accordance with claim 1, wherein the stop is located on the terminal tower external to the terminal cavity.

9. The connector assembly in accordance with claim 1, wherein a direction of the increasing thickness of the unlocking ramp is orthogonal to the direction of the decreasing thickness of the blocking fin.

10. A primary lock reinforcement device, the primary lock reinforcement device moveable from a prestaged position to a full staged position, the primary lock reinforcement device configured to slidably engage a terminal tower disposed within a connector housing of a connector assembly configured to retain an electrical terminal within a terminal cavity defined by the terminal tower, the electrical terminal configured to mate with a corresponding electrical terminal along a mating axis of the connector assembly, the primary lock reinforcement device comprising:

a base and a skirt defining a cavity; and a flexible beam disposed within the cavity that extends from the base parallel to the mating axis and terminates at a tip, wherein the tip flexible beam defines an unlocking ramp increasing in thickness from the tip at an engagement angle and the flexible beam further defines a blocking fin decreasing in thickness from the tip, wherein the blocking fin is arranged orthogonally to the unlocking ramp, wherein a direction of the increasing thickness of the unlocking ramp is orthogonal to the direction of the decreasing thickness of the blocking fin, wherein the blocking fin is positioned to engage a stop formed in the connector housing when the primary lock reinforcement device is in the prestaged position and the electrical terminal is not inserted within the terminal cavity, thereby inhibiting a movement of the primary lock reinforcement device along the mating axis, wherein the unlocking ramp is configured to engage a leading edge of the electrical terminal and to defect the flexible beam such that it is nonparallel to the mating axis when the electrical terminal is inserted into the terminal cavity, thereby disengaging the blocking fin from the stop and enabling the primary lock reinforcement device to move from the prestaged position to the full staged position.

11. The primary lock reinforcement device in accordance with claim 10, wherein a force of less than 45 Newtons is required to move the primary lock reinforcement device from the prestaged position to the full staged position after the electrical terminal is inserted into the terminal cavity.

12. The primary lock reinforcement device in accordance with claim 10, wherein the engagement angle is between 20 degrees and 80 degrees.

13. The primary lock reinforcement device in accordance with claim 12, wherein an insertion force of less than 30 Newtons applied to the electrical terminal is required to deflect the flexible beam.

14. The primary lock reinforcement device in accordance with claim 10, wherein the blocking fin is characterized as having a blocking angle relative to the mating axis of about 90 degrees.

15. The primary lock reinforcement device in accordance with claim 10, wherein a blocking force greater than 80 Newtons is required to move the primary lock reinforcement device from the prestaged position to the full staged position when the electrical terminal is not fully seated in the terminal cavity.

16. The primary lock reinforcement device in accordance with claim 10, wherein a direction of the increasing thickness of the unlocking ramp is orthogonal to the direction of the decreasing thickness of the blocking fin.

* * * * *